US008371804B2

(12) United States Patent
Bilson et al.

(10) Patent No.: US 8,371,804 B2
(45) Date of Patent: Feb. 12, 2013

(54) GAS TURBINE COMPRISING A UNIT FOR DETECTING A SHAFT RUPTURE

(75) Inventors: Christopher Bilson, Berlin (DE); Derek Dewey, Bristol (GB); Andrew Cox, Berlin (DE)

(73) Assignee: MTU Aero Engines GmbH, Munich (DE)

( * ) Notice: Subject to any disclaimer, the term of this patent is extended or adjusted under 35 U.S.C. 154(b) by 860 days.

(21) Appl. No.: 12/065,707

(22) PCT Filed: Aug. 26, 2006

(86) PCT No.: PCT/DE2006/001496

§ 371 (c)(1),
(2), (4) Date: Jan. 28, 2009

(87) PCT Pub. No.: WO2007/028354

PCT Pub. Date: Mar. 15, 2007

(65) Prior Publication Data

US 2009/0220333 A1 Sep. 3, 2009

(30) Foreign Application Priority Data

Sep. 6, 2005 (DE) ..... 10 2005 042 271

(51) Int. Cl.
*F01B 25/26* (2006.01)

(52) U.S. Cl. ..... 415/118; 415/173.1; 415/199.5; 416/61

(58) Field of Classification Search ..... 415/118, 415/173.1, 199.5; 416/61
See application file for complete search history.

(56) References Cited

U.S. PATENT DOCUMENTS

| | | | | |
|---|---|---|---|---|
| 1,326,867 | A * | 12/1919 | Junggren | 415/9 |
| 3,591,308 | A | 7/1971 | Blattner et al. | |
| 3,887,147 | A * | 6/1975 | Grieb | 244/208 |
| 5,411,364 | A | 5/1995 | Aberg et al. | |
| 6,607,349 | B2 * | 8/2003 | Mulera et al. | 415/1 |
| 2007/0160457 | A1 * | 7/2007 | Bilson et al. | 415/118 |

FOREIGN PATENT DOCUMENTS

| | | | |
|---|---|---|---|
| BE | 854 653 | A1 | 11/1977 |
| CH | 445 949 | A | 10/1967 |
| DE | 197 27 296 | A1 | 1/1999 |
| SU | 885 572 | A1 | 11/1981 |
| WO | WO 2005 083237 | A1 | 9/2005 |

* cited by examiner

*Primary Examiner* — Ajay K Arora
(74) *Attorney, Agent, or Firm* — Greer, Burns & Crain, Ltd.

(57) ABSTRACT

A device for detecting a shaft rupture in a rotor of a turbine, in particular a medium-pressure turbine, of a gas turbine, in particular of an aircraft engine, at least one stator-side sensor element being positioned downstream from the turbine, in particular in the area of a stator-side blade ring of another turbine, in particular a low-pressure turbine, and, in case of a shaft rupture of the rotor of the turbine, a radially externally situated segment of a last (seen in the direction of flow) rotor-side blade ring of the turbine working together with the, or with each, sensor element to generate an electrical signal corresponding to the shaft rupture.

13 Claims, 6 Drawing Sheets

GAS TURBINE COMPRISING A UNIT FOR DETECTING A SHAFT RUPTURE

The present invention relates to a device for detecting a shaft rupture in a gas turbine. The present invention also relates to a gas turbine.

Gas turbines that are fashioned as aircraft engines have at least one compressor, at least one combustion chamber, and at least one turbine. From the prior art, aircraft engines are known that have on the one hand three compressors positioned upstream from the combustion chamber, as well as three turbines positioned downstream from the combustion chamber. The three compressors are a low-pressure compressor, a medium-pressure compressor, and a high-pressure compressor. The three turbines are a high-pressure turbine, a medium-pressure turbine, and a low-pressure turbine. According to the prior art, the rotors of the high-pressure compressor and the high-pressure turbine, of the medium-pressure compressor and medium-pressure turbine, and of the low-pressure compressor and the low-pressure turbine are in each case connected to one another by a shaft, the three shafts being arranged concentrically, so that they are nested.

If, for example, the shaft that connects the medium-pressure compressor to the medium-pressure turbine ruptures, the medium-pressure turbine can no longer take work or power from the medium-pressure compressor, and this can result in excessive rotational speed of the medium-pressure turbine. Such failure of the medium-pressure turbine must be avoided, because this can damage the entire aircraft engine. Accordingly, for safety reasons a shaft rupture of a gas turbine must be capable of being reliably detected in order to interrupt the supply of fuel to the combustion chamber if a shaft rupture occurs. Such a detection of a shaft rupture is difficult in particular if the gas turbine as described above has three shafts that are situated concentrically to one another and are thus nested. In this case, above all it is difficult to detect a rupture of the middle shaft, which couples the medium-pressure turbine to the medium-pressure compressor. A similar problem exists for stationary gas turbines as well.

On this basis, the present invention seeks to address the problem of creating a new type of device for detecting a shaft rupture in a gas turbine.

This problem is solved by a device for detecting a shaft rupture in a gas turbine as indicated in patent claim 1. The present invention proposes a device for detecting a shaft rupture in a rotor of a turbine of a gas turbine in which at least one stator-side sensor element is positioned downstream from the turbine, in particular in the area of a stator-side blade ring of another turbine, in particular a low-pressure turbine, and in which, when there is a shaft rupture of the rotor of the turbine, a radially external section of a last (seen in the direction of flow) rotor-side blade ring of the turbine works together with the, or with each, sensor element to generate an electrical signal corresponding to the shaft rupture.

The present invention creates an effective solution, having a relatively simple construction, for detecting a rupture of a shaft that connects a turbine to a compressor.

Preferably, at least one stator-side sensor element is allocated to a first (seen in the direction of flow) stator-side blade ring of a low-pressure turbine positioned downstream from a medium-pressure turbine, such that in the case of a shaft rupture the radially externally situated segment of the last (seen in the direction of flow) rotor-side blade ring of the medium-pressure turbine works together with the, or with each, sensor element in such a way that a shaft rupture can be detected. For this purpose, an electrical signal is generated that corresponds to the shaft rupture and is transmitted to a switching element in order to interrupt the supply of flow to the combustion chamber as a reaction to the shaft rupture.

Preferably, the, or each, sensor element is fashioned as a conductor, in particular as a mineral-insulated conductor, such that when there is a shaft rupture of the rotor of the turbine, the radially externally situated segment of the last (seen in the direction of flow) rotor-side blade ring cuts through the, or through each, conductor, thus generating an electrical signal corresponding to the shaft rupture.

The gas turbine according to the present invention is defined in patent claim 12.

Preferred developments of the present invention result from the subclaims and the following description. Exemplary embodiments of the present invention, which is not limited to these embodiments, are explained in more detail on the basis of the drawing.

Figure 5:
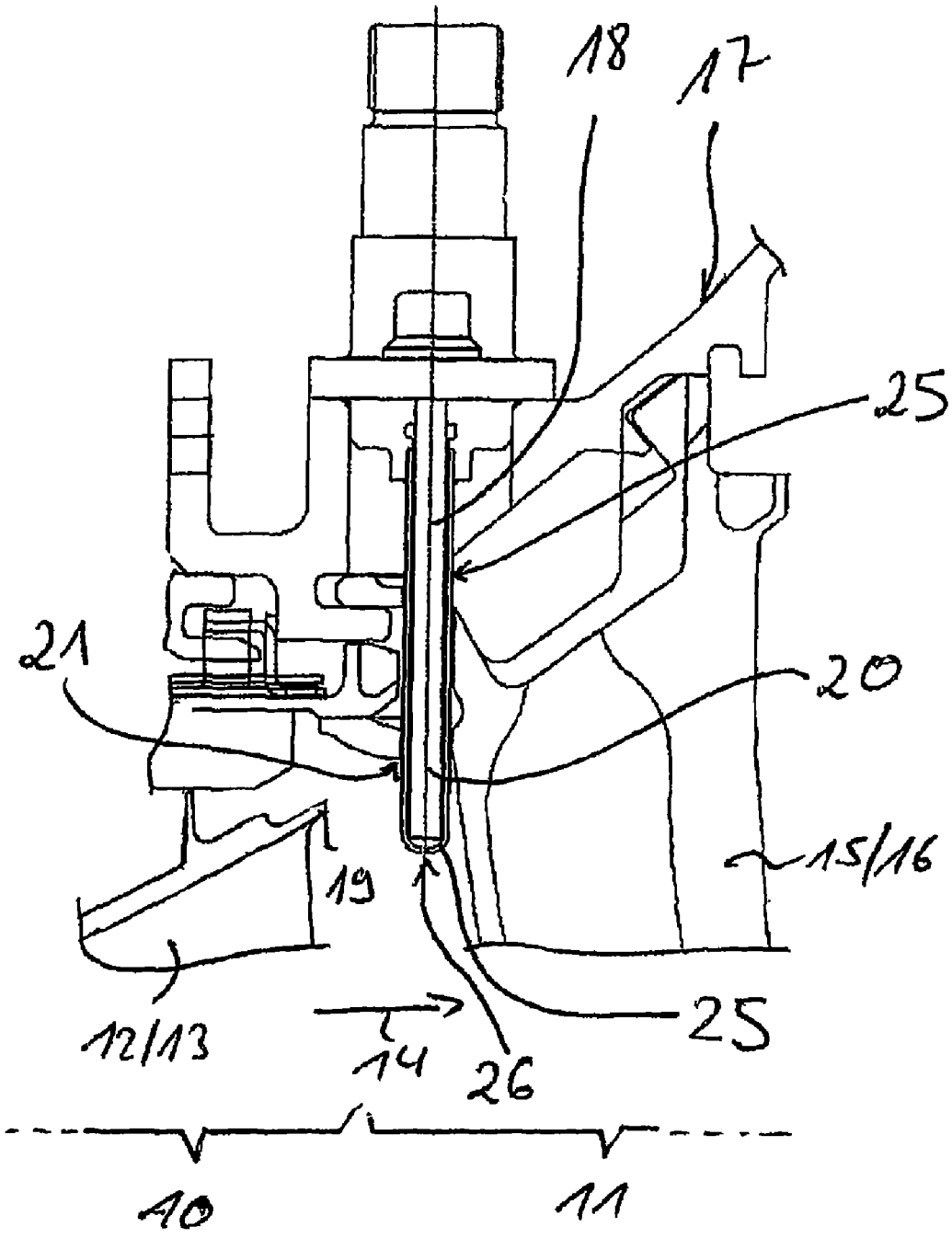
Figure 6:
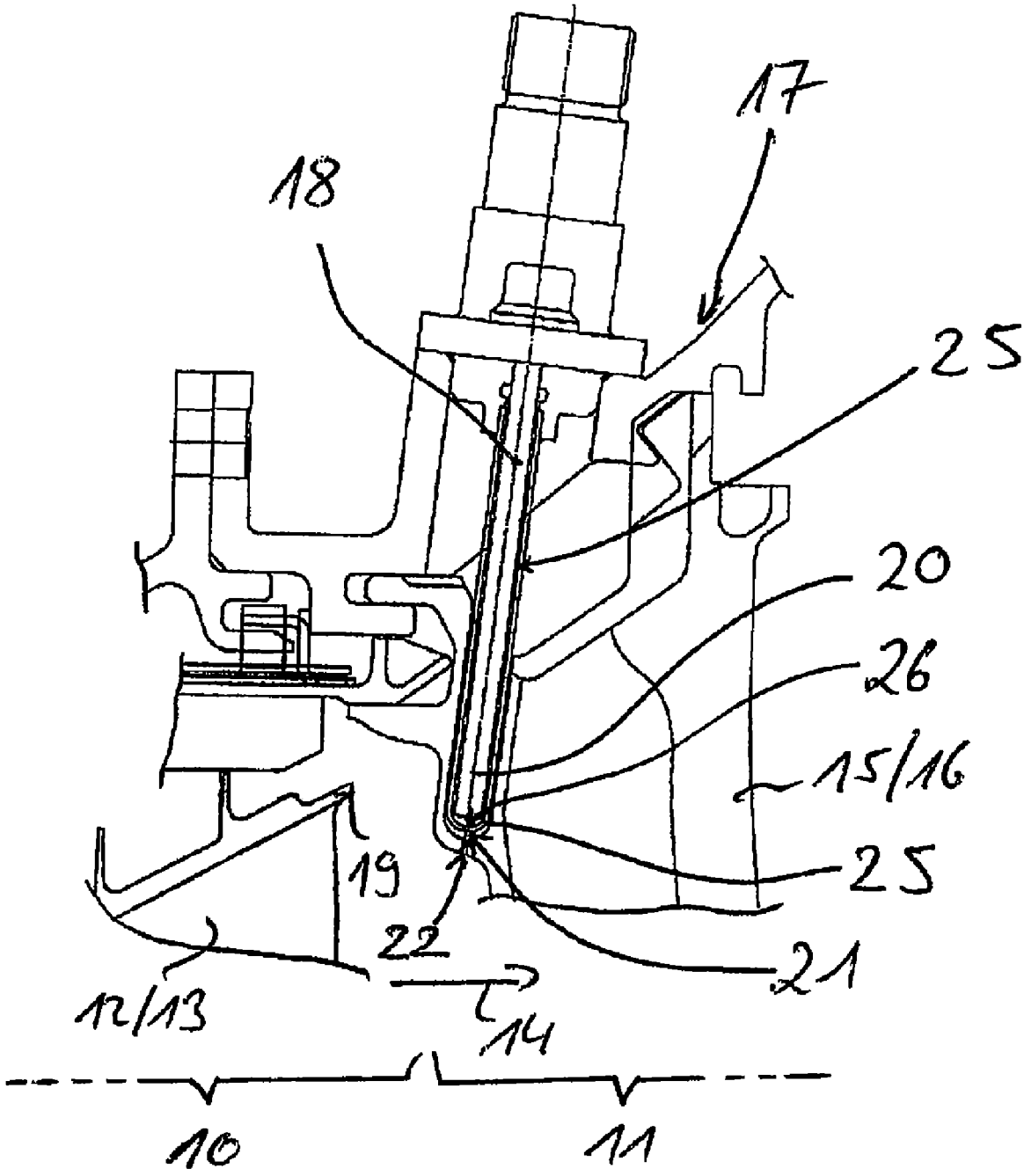

FIG. 5 shows a segment of a gas turbine according to the present invention having a device according to the present invention for detecting a shaft rupture in a gas turbine according to a third exemplary embodiment of the present invention; and FIG. 6 shows a segment of a gas turbine according to the present invention having a device according to the present invention for detecting a shaft rupture in a gas turbine according to another exemplary embodiment of the present invention.

In the following, the present invention is described in more detail with reference to FIGS. 1 to 6.

Figure 1:
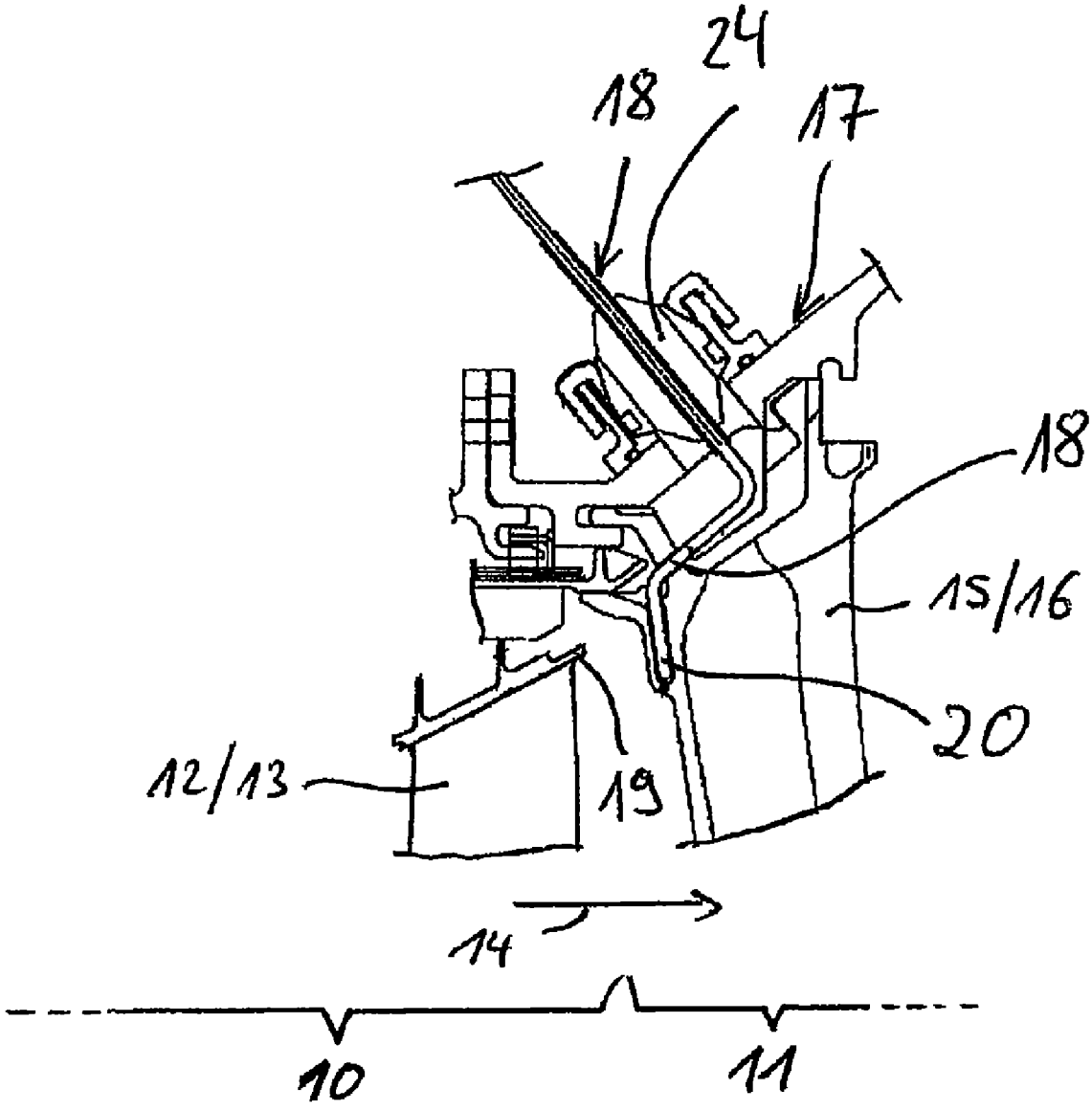
FIG. 1 shows a segment of a gas turbine according to the present invention having a device according to the present invention for detecting a shaft rupture in a gas turbine according to a first exemplary embodiment of the present invention.

FIG. 1 shows a segment of a gas turbine according to the present invention, namely an aircraft engine, according to a first exemplary embodiment of the present invention, between a rotor of a medium-pressure turbine 10 and a stator of a low-pressure turbine 11. Of the rotor of medium-pressure turbine 10, the Figure shows a radially externally situated segment 12 of a blade 13 of the last (seen in the direction of flow (arrow 14)) blade ring of medium-pressure turbine 10. Of the stator of low-pressure turbine 11, the Figure shows a radially externally situated segment 15 of a blade 16 of the first (seen in the direction of flow (arrow 14)) blade ring of low-pressure turbine 11; a housing segment 17 is also shown.

The first or frontmost (seen in the direction of flow) blade ring of low-pressure turbine 11 is accordingly adjacent to the last or rearmost (seen in the direction of flow) blade ring of medium-pressure turbine 10. A high-pressure turbine is positioned upstream from medium-pressure turbine 10.

As already mentioned, in such gas turbines, which have three turbines as well as three compressors, the rotors of high-pressure turbines as well as high-pressure compressors, medium-pressure turbines as well as medium-pressure compressors, and low-pressure turbines and low-pressure compressors are each connected to each other by a shaft, these three shafts being situated concentrically so that they are nested in one another. The subject matter of the present invention includes the provision of a device for detecting a shaft rupture in a gas turbine that is suitable in particular for detecting a rupture of the shaft that connects the medium-pressure turbine rotor to the medium-pressure compressor rotor. This is because if this shaft breaks, the medium-pressure compressor of the medium-pressure turbine can no longer consume work or power, which can result in excessive rotational speed of the medium-pressure turbine. Because such excessive rotational speed of the turbine can result in severe damage to the aircraft engine, a shaft rupture must be reliably detected.

In the depicted exemplary embodiments, at least one sensor element 18 is positioned in the area of the first (seen in the direction of flow) stator-side blade ring of low-pressure turbine 11. The, or each, sensor element 18 is allocated to a radially externally situated segment of this blade ring of low-pressure turbine 11, and thus to a radially externally situated segment of a flow duct of low-pressure turbine 11. In order to detect a shaft rupture, the, or each, sensor element 18 works together with radially externally situated segment 12 of the last (seen in the direction of flow (arrow 14)) rotor-side blade ring of medium-pressure turbine 10 in such a way that when there is a shaft rupture the rearmost or last (seen in the direction of flow) blade ring of medium-pressure turbine 10 comes into contact, via its radially externally situated segment 12, with sensor element 18, preferably cutting through it, in order in this way to generate an electrical signal corresponding to the shaft rupture and to transmit this signal to a switching element (not shown).

Here, the, or each, sensor element is fashioned as an electrical conductor, preferably as a mineral-insulated current conductor, that, when there is a shaft rupture, is cut through by the radially externally situated segment 12 of the last (seen in the direction of flow) blade ring of medium-pressure turbine 10. This is because, as a result of the pressure conditions in a turbine, when there is a rupture of the shaft connecting medium-pressure turbine 10 to the medium-pressure compressor (not shown), the rotor of medium-pressure turbine 10 moves in the direction of flow (arrow 14) and thus in the direction towards the first blade ring of low-pressure turbine 11. The, or each, sensor element 18, fashioned as a conductor, is then cut through by a protruding (in the direction of flow) segment 19 of an outer covering band of the last (seen in the direction of flow) blade ring of medium-pressure turbine 10.

Figure 2:
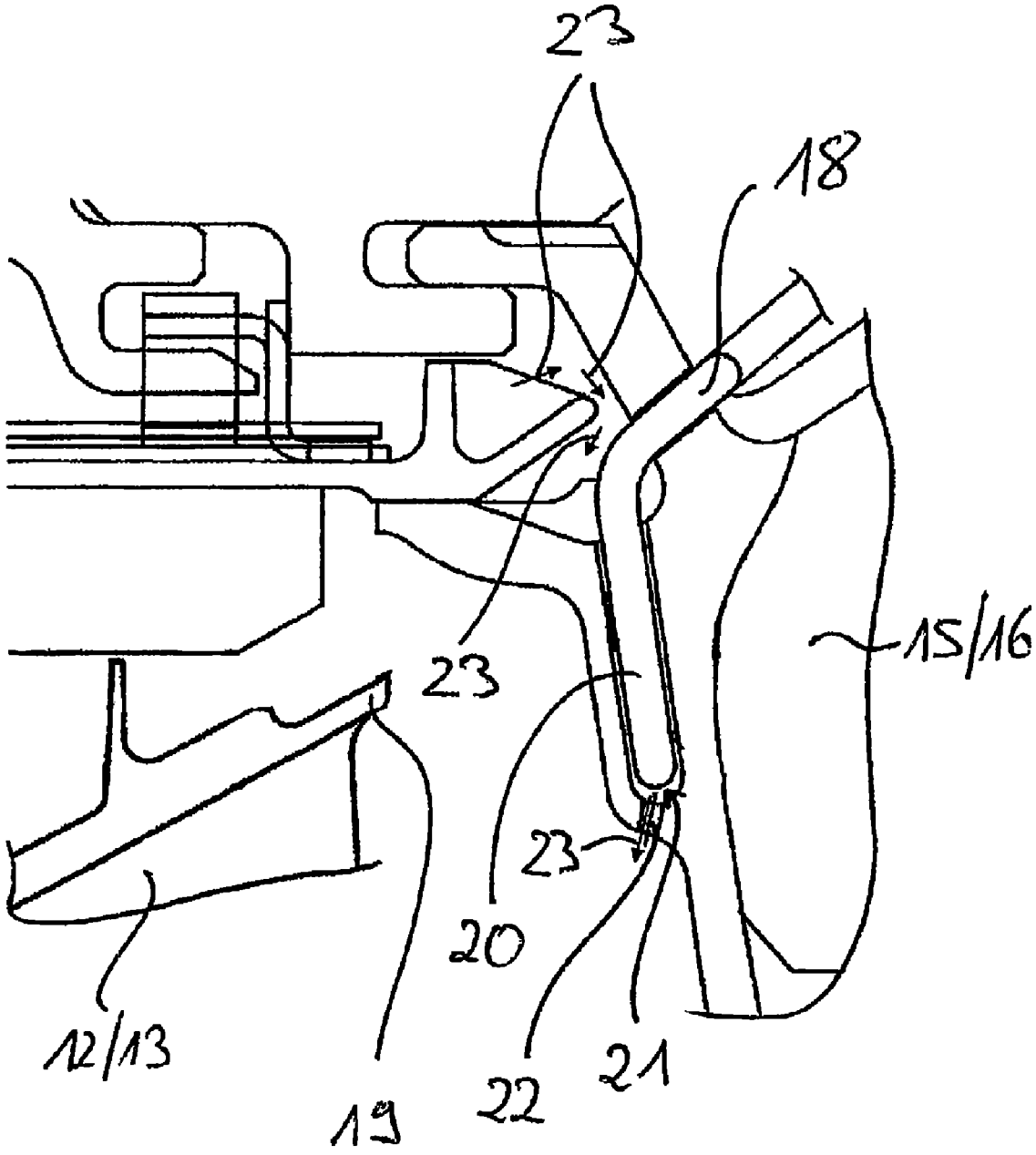
FIG. 2 shows an enlarged detail of the arrangement of FIG. 1.

As can be seen in FIG. 1, the, or each, sensor element 18 is led radially from the outside to the first (seen in the direction of flow) blade ring of low-pressure turbine 11, and is introduced with an end segment 20 into a recess 21 of the first (seen in the direction of flow) blade ring of low-pressure turbine 11, this recess 21 being allocated to the radially externally situated segment 15 of blades 16 of the first blade ring of low-pressure turbine 11. In the exemplary embodiment shown in FIGS. 1 and 2, the respective end segment 20 of the, or of each, sensor element 18 extends into the respective recess 21 and is enclosed in blade ring 16. Here, recess 21 is bounded, on the side facing the last (seen in the direction of flow) rotor-side blade ring of medium-pressure turbine 10, by a material thickness that can be cut or penetrated by segment 19 of the outer covering band of the last (seen in the direction of flow) blade ring of medium-pressure turbine 10 when there is a shaft rupture. After the penetration of this material segment, segment 19 reaches end segment 20 of respective sensor element 18, cuts through sensor element 18, and in this way generates an electrical signal corresponding to the shaft rupture. As can be seen in particular in FIG. 2, in the area of recess 21 an opening 22 is formed that creates a connection of recess 21 to the flow duct, in order in this way to conduct a flow through recess 21 for cooling respective sensor element 18. FIG. 2 indicates, with arrows 23, the cooling flow that is directed past the respective sensor element 18 in order to cool it. This flow is preferably branched off from a relatively cold bypass flow, is directed past the respective sensor element 18, and is conducted via opening 22 into the flow duct of low-pressure turbine 11.

In the exemplary embodiment of FIGS. 1 and 2, the, or each, sensor element 18, coming radially from the outside, is guided in a curved shape in order to introduce end segment 20 into the respective recess 21. A ferrule 24 grasps housing 17 radially outwardly in order to guide the respective sensor element 18 and to seal it. Preferably, a plurality of such sensor elements 18 are positioned so as to be equally distributed around the circumference of the blade ring of low-pressure turbine 11; when at least one such sensor element is cut through, the presence of a shaft rupture is inferred.

Figure 3:
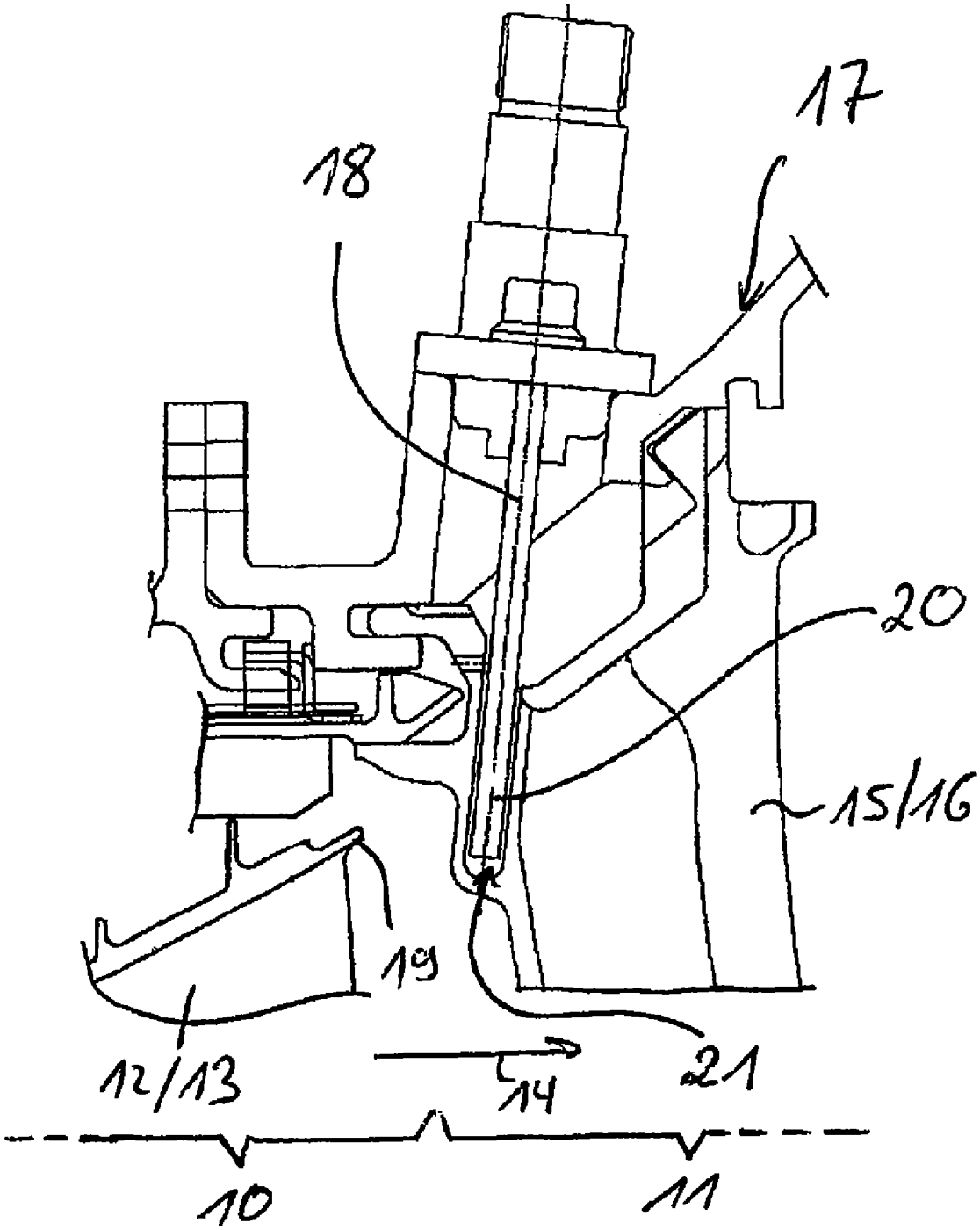
FIG. 3 shows a segment of a gas turbine according to the present invention having a device according to the present invention for detecting a shaft rupture in a gas turbine according to a second exemplary embodiment of the present invention.
Figure 4:
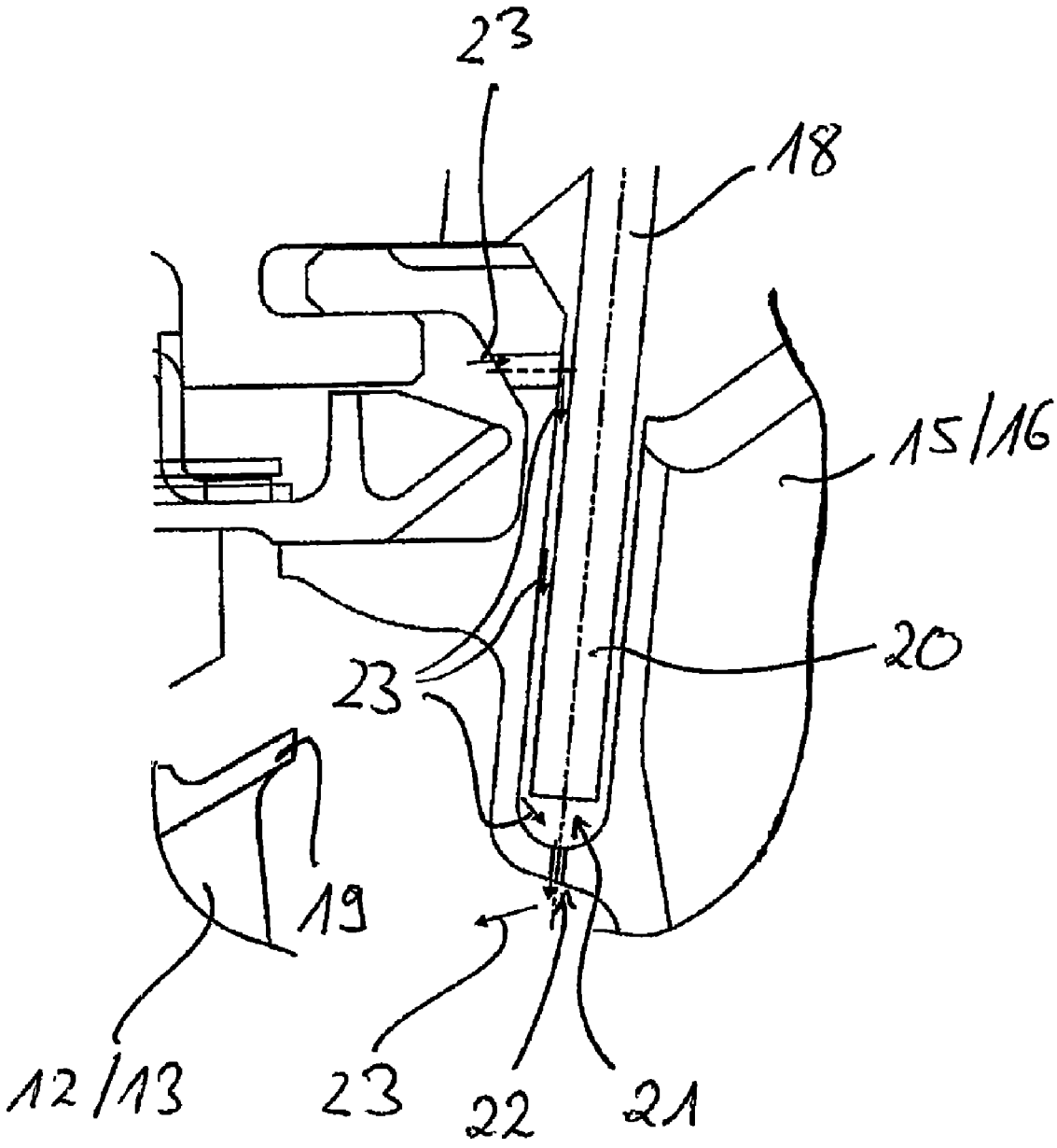
FIG. 4 shows an enlarged detail of the arrangement of FIG. 3.

FIGS. 3 and 4 show a second exemplary embodiment of the present invention, corresponding essentially to the exemplary embodiment shown in FIGS. 1 and 2. Therefore, in order to avoid unnecessary repetition identical reference characters are used for identical components, and in the following only those details are discussed that distinguish the exemplary embodiment of FIGS. 3 and 4 from the exemplary embodiment of FIGS. 1 and 2. Thus, in the exemplary embodiment of FIGS. 3 and 4, the, or each, sensor element 18 is in turn led radially from the outside to the first (seen in the direction of flow) blade ring of low-pressure turbine 11, and is introduced into a corresponding recess 21; in the exemplary embodiment shown in FIGS. 3 and 4, sensor element 18 is introduced with its end segment 20 into the corresponding recess 21 in a straight line, without deflections or bending. In this way, sensor element 18 can easily be withdrawn from recess 21 for maintenance without having to take apart the gas turbine, in particular low-pressure turbine 11 thereof. With regard to the remaining details, reference is made to the description of the exemplary embodiment shown in FIGS. 1 and 2.

FIG. 5 shows a third exemplary embodiment of the present invention. In the exemplary embodiment of FIG. 5, the, or each, sensor element 18 is sheathed by an armor 25. The, or each, sensor element 18 penetrates, together with the respective armor 25, a recess 21 of the first (seen in the direction of flow) blade ring of low-pressure turbine 11, but, differing from the exemplary embodiment shown in FIGS. 1 and 2 or that shown in FIGS. 3 and 4, in the exemplary embodiment shown in FIG. 5 end segment 20 of sensor element 18 is not enclosed in the blade ring, but rather protrudes into the flow duct, namely into a segment situated between the last (seen in the direction of flow) rotor-side blade ring of medium-pressure turbine and the first (seen in the direction of flow) stator-side blade ring of low-pressure turbine 11. In this case, when there is a shaft rupture, segment 19, which protrudes in the direction of flow, of the outer covering band of the blade ring of medium-pressure turbine 10 must penetrate or break through armor 25 in order in this way to cut through corresponding sensor element 18 and to generate an electrical signal corresponding to the shaft rupture. As can be seen in FIG. 5, an opening 26 is integrated into armor 25 in order in this way to conduct a flow between armor 25 and respective sensor element 18 in order to cool respective sensor element 18. This flow can then escape via opening 26 into the flow duct of low-pressure turbine 11.

Another exemplary embodiment of the present invention is shown in FIG. 6, which corresponds essentially to the exemplary embodiment shown in FIG. 3. The difference between the exemplary embodiment of FIG. 6 and that of FIG. 3 is that in the exemplary embodiment of FIG. 6, armor 25 is additionally present. When there is a rupture of the shaft that connects medium-pressure turbine 10 to the medium-pressure compressor, segment 19, protruding in the direction of flow, of the last (seen in the direction of flow) blade ring of medium-pressure turbine must accordingly penetrate both the material that bounds recess 20 on the side facing the blade ring and also armor 25, in order to come into contact with sensor 18. With respect to the remaining details, reference is made to the above description.

In the depicted exemplary embodiments, the, or each, sensor element is positioned in the area of a stator-side blade ring. It is to be noted that the, or each, sensor element can also be allocated to other stator-side assemblies of the gas turbine.

The present invention proposes a device for detecting a shaft rupture in a rotor of a gas turbine, in which a radially outwardly situated end of a last (seen in the direction of flow) blade ring of the turbine that is connected to the shaft that is to be monitored for rupture works together with at least one sensor element that is allocated to a stator, in particular a first (seen in the direction of flow) blade ring of a turbine that is positioned downstream. The, or each, sensor element is preferably fashioned as a mineral-insulated conductor that, when there is a shaft rupture, is broken through or cut through by a segment, protruding in the direction of flow, of an outer covering band of the last (seen in the direction of flow) blade ring of the turbine that is connected to the shaft that is to be monitored for rupture. If at least one such mineral-insulated conductor is cut through, the presence of a shaft rupture can be inferred. The mineral-insulated conductor has a diameter between 1 and 4 mm, preferably between 2 and 3 mm. During operation of the gas turbine, in order to cool the mineral-insulated conductor a gas flow is directed past it in order to cool it to a temperature of approximately 900° C.

The invention claimed is:

1. A device for detecting a shaft rupture in an aircraft engine including a plurality of turbines and a plurality of compressors interconnected by a plurality of nested shafts, the device comprising:

at least one sensor element located rotor-side and positioned downstream from a rotor-side blade ring of one of the turbines and, in case of a rupture of one of the shafts, a radially externally situated segment of a last rotor-side blade ring of the turbine cuts through said at least one sensor element to generate an electrical signal corresponding to the shaft rupture.

2. The device as recited in claim 1, wherein said at least one sensor element is sheathed by an armor.

3. The device as recited in claim 2, wherein the armor has an opening, so that a flow can take place through these elements in order to cool the respective sensor element.

4. An aircraft engine comprising:

a plurality of compressors;

a plurality of turbines;

a plurality of nested, concentrically arranged shafts connecting said plurality of compressors and said plurality of turbines; and at least one sensor element located rotor-side and positioned downstream from a rotor-side blade ring of one of the turbines and, in case of a rupture of one of the nested shafts, a radially externally situated segment of a last rotor-side blade ring of the turbine cuts through said at least one sensor element to generate an electrical signal corresponding to the shaft rupture.

5. The aircraft engine recited in claim 4, wherein said at least one sensor element defines an opening so that a flow can move into and adjacent to at least one contact element for cooling the at least one element.

6. A device for detecting a shaft rupture in an aircraft engine including a plurality of turbines and a plurality of compressors interconnected by a plurality of nested shafts, the device comprising:

at least one sensor element located rotor-side and positioned downstream from a rotor-side blade ring of one of the turbines and, in case of a rupture of one of the shafts, a radially externally situated segment of a last rotor-side blade ring of the turbine working together with said at least one sensor element to generate an electrical signal corresponding to the shaft rupture, said at least one sensor element being a conductor, wherein the radially externally situated segment of the last rotor-side blade ring cuts through said conductor when there is a shaft rupture of the rotor of the turbine thereby generating an electrical signal corresponding to the shaft rupture.

7. The device as recited in claim 6, wherein the conductor is fashioned as a mineral-insulated conductor.

8. The device as recited in claim 6, wherein the mineral-insulated conductor has a thickness or diameter between 2 and 3 mm.

9. A device for detecting a shaft rupture in an aircraft engine including a plurality of turbines and a plurality of compressors interconnected by a plurality of nested shafts, the device comprising:

a plurality of sensor elements located rotor-side and positioned downstream from a rotor-side blade ring of one of the turbines, said plurality of sensor elements are distributed around a circumference of the rotor-side blade ring, and, in case of a rupture of one of the shafts, a radially externally situated segment of a last rotor-side blade ring of the turbine working together with at least one of said plurality of sensor elements to generate an electrical signal corresponding to the shaft rupture.

10. A device for detecting a shaft rupture in an aircraft engine including a plurality of turbines and a plurality of compressors interconnected by a plurality of nested shafts, the device comprising:

at least one sensor element located rotor-side and positioned downstream from a rotor-side blade ring of one of the turbines and, in case of a rupture of one of the shafts, a radially externally situated segment of a last rotor-side blade ring of the turbine working together with said at least one sensor element to generate an electrical signal corresponding to the shaft rupture, said at least one sensor element being led radially from the outside to a first blade ring of an additional one of the turbines, and is introduced in each case into a radially externally positioned recess of the rotor-side blade ring.

11. The device as recited in claim 10, wherein an end segment of said at least one sensor element protrudes into the respective recess of the blade ring, and is enclosed therein.

12. The device as recited in claim 10, wherein the respective recess is bounded, on the side facing the last rotor-side blade ring of the turbine, by a material thickness that is capable of being penetrated by the last, rotor-side blade ring of the turbine when there is a shaft rupture.

13. The device as recited in claim 10, wherein an end segment of said at least one sensor element penetrates a respective recess of the blade ring, and protrudes into the flow duct between the last rotor-side blade ring of the turbine and the blade ring of the additional turbine.

* * * * *